US007592963B2

(12) United States Patent
Cheng

(10) Patent No.: US 7,592,963 B2
(45) Date of Patent: Sep. 22, 2009

(54) MULTI-BAND SLOT RESONATING RING ANTENNA

(75) Inventor: Dajun Cheng, Acton, MA (US)

(73) Assignee: Intel Corporation, Santa Clara, CA (US)

( * ) Notice: Subject to any disclaimer, the term of this patent is extended or adjusted under 35 U.S.C. 154(b) by 369 days.

(21) Appl. No.: 11/540,444

(22) Filed: Sep. 29, 2006

(65) Prior Publication Data

US 2008/0079644 A1 Apr. 3, 2008

(51) Int. Cl.
*H01Q 13/10* (2006.01)

(52) U.S. Cl. ..... 343/770; 343/769

(58) Field of Classification Search ..... 343/769, 343/770, 767, 700 MS, 846
See application file for complete search history.

(56) References Cited

U.S. PATENT DOCUMENTS

| | | | | |
|---|---|---|---|---|
| 4,208,660 | A * | 6/1980 | McOwen, Jr. | 343/769 |
| 4,320,402 | A * | 3/1982 | Bowen | 343/700 MS |
| 4,443,802 | A | 4/1984 | Mayes | |
| 4,903,033 | A * | 2/1990 | Tsao et al. | 343/700 MS |
| 4,947,178 | A * | 8/1990 | Shafai | 343/700 MS |
| 5,025,264 | A | 6/1991 | Stafford | |
| 5,241,321 | A * | 8/1993 | Tsao | 343/700 MS |
| 5,714,961 | A * | 2/1998 | Kot et al. | 343/769 |
| 6,018,320 | A * | 1/2000 | Jidhage et al. | 343/700 MS |
| 6,246,370 | B1 * | 6/2001 | Wixforth | 343/700 MS |
| 6,369,759 | B1 * | 4/2002 | Epp et al. | 343/700 MS |
| 6,518,930 | B2 * | 2/2003 | Itoh et al. | 343/767 |
| 7,106,264 | B2 * | 9/2006 | Lee et al. | 343/767 |

OTHER PUBLICATIONS

Bolzer, F L., et al., "Multi-Band Annular Slot Antenna for WLAN Applications", *11th International Conference on Antennas and Propagation, Conference Publication* No. 480, (Apr. 17-20, 2001),529-532 Pgs.

Chen, Jin-Sen , "Dual-Frequency Annular-Ring Slot Antennas Fed by CPW Feed and Microstrip Line Feed", *IEEE Transactions on Antennas and Propagation*, vol. 53, No. 1., (Jan. 2005),569-571 Pgs.

Chen, Jin-Sen , "Multi-frequency characteristics of annular-ring slot antennas", *Microwave and Optical Technology Letters*/ vol. 38, No. 6., (Sep. 20, 2003),506-511 Pgs.

Joshi, Ravi K., et al., "Broadband Concentric Rings Fractal Slot Antenna", *XXVIIIth General Assembly of International Union of Radio Science* (*URSI*). (Oct. 23-29, 2005),4 Pgs.

Nikolaou, Symeon , et al., "Pattern and Frequency Reconfigurable Annular Slot Antenna Using PIN Diodes", *IEEE Transactions on Antennas and Propagation*, vol. 54, No. 2., (Feb. 2006),439-448 Pgs.

Tehrani, Hooman , et al., "Multifrequency Operation of Microstrip-Fed Slot-Ring Antennas on Thin Low-Dielectric Permittivity Substrates", *IEEE Transactions on Antennas and Propagation*, vol. 50, No. 9., (Sep. 2002),1299-1308 Pgs.

* cited by examiner

*Primary Examiner*—HoangAnh T Le
(74) *Attorney, Agent, or Firm*—Dana B. Lemioine; Lemioine Patent Services, PLLC

(57) ABSTRACT

A multi-band slot resonating ring antenna (SRRA) is suitable to be manufactured on a circuit board. A first conductive plane includes concentric slots corresponding to different frequency bands. The antenna may be fed by microstrip feed lines. The antenna may also be fed by probes. A conductive layer may include coupling apertures to couple signal energy to the concentric slots.

13 Claims, 14 Drawing Sheets

MULTI-BAND SLOT RESONATING RING ANTENNA

FIELD

The present invention relates generally to antennas, and more specifically to slot resonating ring antennas.

BACKGROUND

Advances in circuit technologies and packaging technologies have allowed wireless communications devices to include more features while at the same time becoming smaller. For example, many modern, small form factor, wireless devices such as cellular telephones can transmit and receive in multiple frequency bands, whereas previous generation, larger, wireless devices may have only been able to transmit and receive in a single frequency band. Wireless devices capable of transmitting and receiving in multiple frequency bands ("multi-band") can benefit from compact multi-band antenna designs.

DESCRIPTION OF EMBODIMENTS

Figure 1:
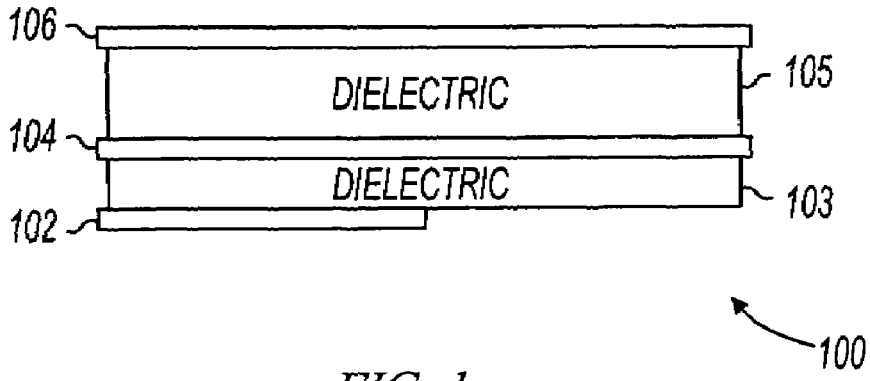
FIG. 1 shows a circuit board cross-section.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular, feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

FIG. 1 shows a circuit board cross section. Circuit board 100 includes three substantially parallel conductive layers 102, 104, and 106, separated by dielectric layers 103 and 105. The conductive layers may be composed of any conductive material. For example, conductive layers 102, 104, and 106 may include copper. Dielectric layers 103 and 105 may be any material suitable to electrically insulate conductive layers 102, 104, and 106. Circuit board 100 may be manufactured using any suitable circuit board manufacturing technique.

In some embodiments of the present invention, one or both of conductive layers 104 and 106 provide a reference voltage plane to circuits coupled to the circuit board. For example, conductive layer 106 may be a "ground" plane that provides a low impedance current return path to one or more power supplies. Further, conductive layer 106 may be a "voltage" plane that provides a low impedance current path from one or more power supplies.

As described further below, conductive layer 106 may have slots formed to provide a multi-band slot resonating ring antenna. In addition, conductive layer 102 may include one or more microstrip feed lines to emit signal energy to be coupled to the antenna. Further, conductive layer 104 may include one or more coupling apertures to allow the energy to pass from the feed line to the antenna. Although circuit board 100 is shown with three conductive layers, this is not a limitation of the present invention. For example, in some embodiments, circuit board 100 may include more than three conductive layers.

Figure 2:
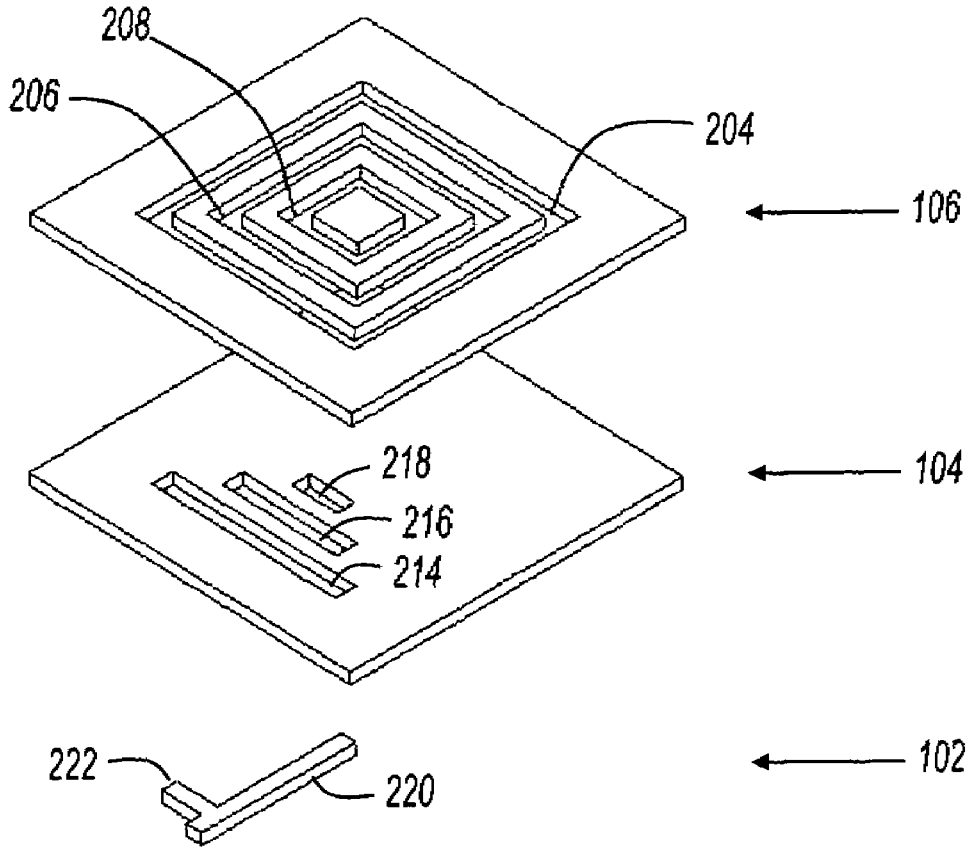
FIG. 2 shows an exploded view of conductive layers of a multi-band slot resonating ring antenna.

FIG. 2 shows an exploded view of the conductive layers of a multi-band slot resonating ring antenna formed in circuit board 100 (FIG. 1). Conductive layer 106 is shown having concentric slots 204, 206, and 208. Concentric slots 204, 206, and 208 are slot resonating rings (SRR) that form part of a compact multi-band slot resonating ring antenna (SRRA). Each of the rings is a radiation element in the antenna. In the example of FIG. 2, three rings are present, each having a different resonating frequency. This forms a tri-band antenna, although this is not a limitation of the present invention. The remainder of this description focuses on tri-band SSRA embodiments, however other embodiments exist that operate on fewer or more than three frequency bands. As shown in FIG. 2, the outer slot 204 corresponds to the central frequency of the lowest operating frequency band, the middle slot 206 corresponds to that of the middle frequency band, and the internal slot 208 corresponds to that of the highest frequency band. In this way, the radiation elements are sequentially and concentrically placed inside the other element(s) with larger physical size(s). With such configuration, the radiation volume of the proposed SRRA is reusable at all frequency bands, and the dimensions of the overall antenna are greatly reduced. In addition, since the slot resonating rings may be etched on the ground plane of the printed circuit board (PCB), the SRRA is easily integrated with the PCB.

Conductive layer 104 is shown having coupling apertures 214, 216, and 218. Conductive layer 102 is shown having feed line 220. In some embodiments, feed line 220 is a signal trace that emits signal energy, and each of the slot resonating rings 204, 206, and 208 is electromagnetically coupled to feed line 220 through the separate apertures 214, 216, and 218. In other embodiments, feed line 220 is a signal trace that receives signal energy from the slots through the apertures. As shown in FIG. 2, feed line 220 includes matching circuit 222 to increase the coupling and associated power transfer.

In some embodiments, the coupling apertures are aligned with an associated slot. For example, aperture 214 may be aligned with slot 204; aperture 216 may be aligned with slot 206, and aperture 218 may be aligned with slot 208. As shown in FIG. 2, the concentric slots in conductive layer 106 are square-shaped. In other embodiments, the concentric slots are circles, and in other embodiments, the concentric slots are elliptical. The shape of the concentric slots is not a limitation of the present invention.

Figure 3:
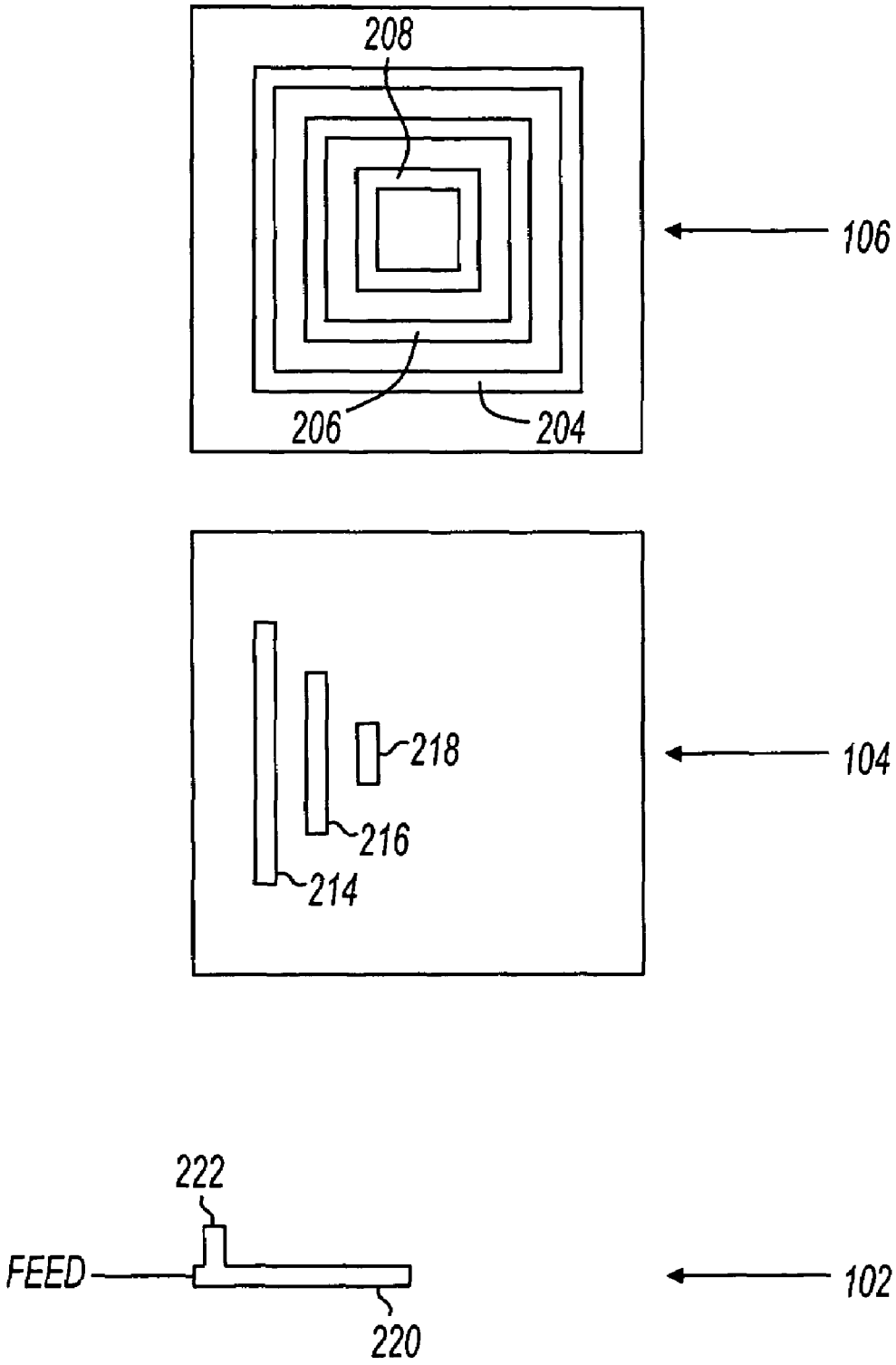
FIG. 3 shows a plan view of each layer of the multi-band slot resonating ring antenna of FIG. 2.

FIG. 3 shows a plan view of each layer of the multi-band slot resonating ring antenna of FIG. 2. Layer 106 shows the concentric slots 204, 206, and 208; layer 104 shows coupling apertures 214, 216, and 218; and layer 102 shows feed line 220 with matching circuit 222. As shown in FIG. 3, each of the apertures are placed beneath a corresponding one of the concentric slots to couple signal energy between the feed line and the slot resonating rings.

Figure 4:
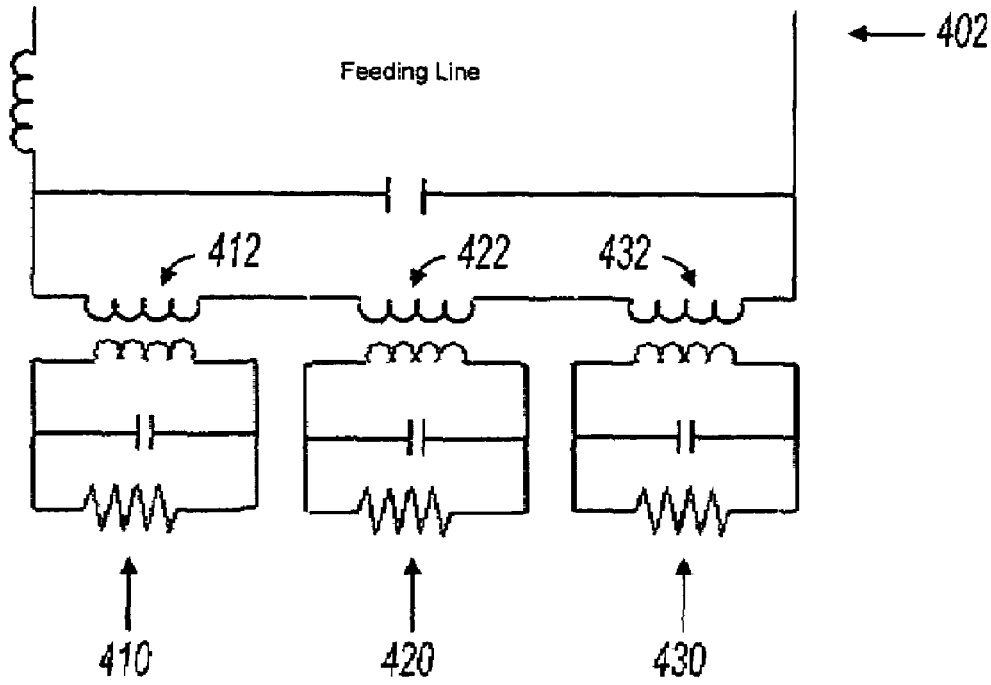
FIG. 4 shows an equivalent circuit for a multi-band slot resonating ring antenna.

FIG. 4 shows an equivalent circuit for a multi-band slot resonating ring antenna. The top portion 402 models the feed line 220 (FIG. 2). The operation of the coupling apertures 214, 216, and 218 is modeled by coupling circuits 412, 422, and 432, respectively. The operation of concentric slots 204, 206, and 208 is modeled by resonating circuits 410, 420, and 430, respectively. Each of the resonating circuits 410, 420, and 430, have a different resonating frequency corresponding to the resonant frequency of the associated concentric slot.

Figure 5:
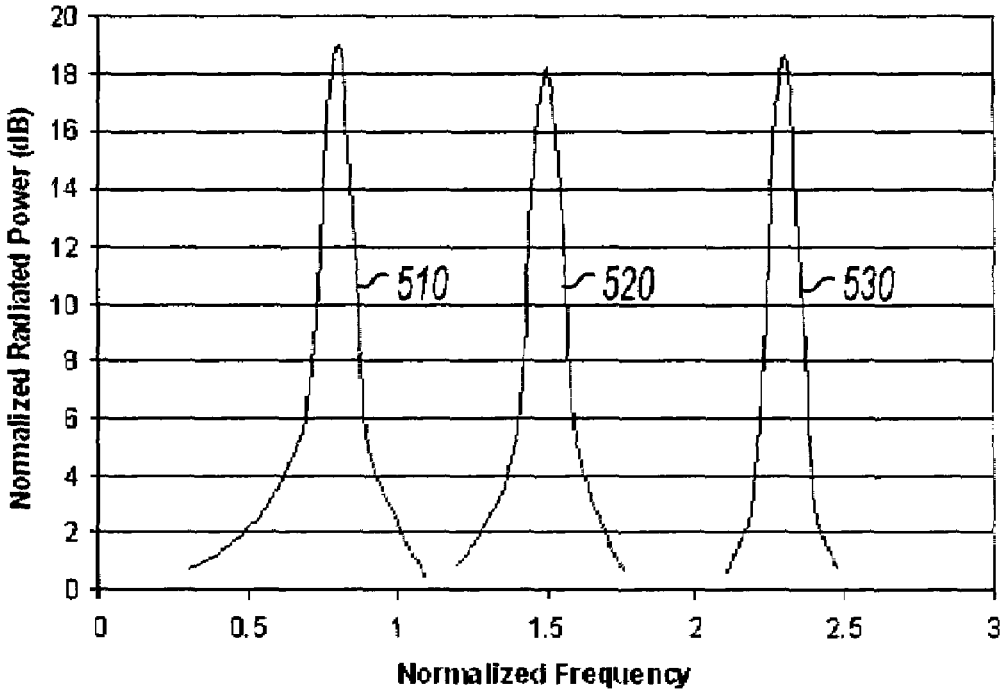
FIG. 5 shows a frequency response of a slot resonating ring antenna according to various embodiments of the present invention.

FIG. 5 shows a frequency response of a slot resonating ring antenna according to various embodiments of the present invention. Curves 510, 520, and 530 represent power radiated from concentric slots 204, 206, and 208, respectively. The frequency axis is normalized to show that any SRRAs disclosed herein maybe formed to operate at any combination of frequencies.

Figure 6:
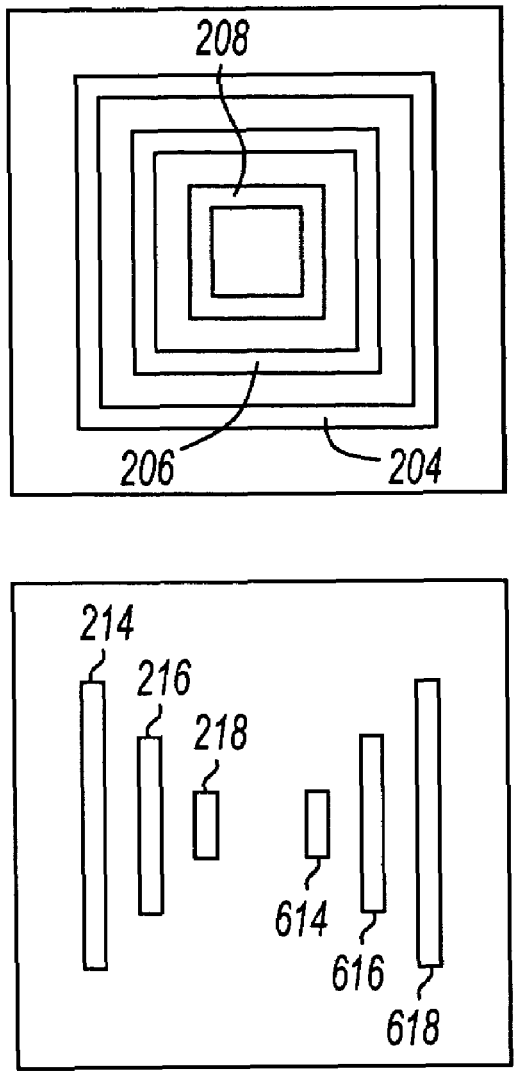
FIGS. 6-8 show plan views of conductive layers for various multi-band slot resonating ring antenna embodiments.
Figure 6:
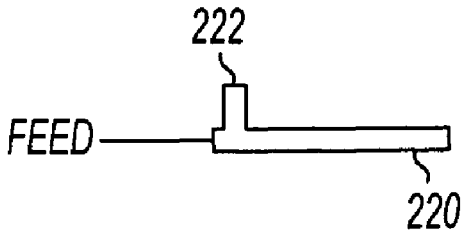

FIG. 6 shows a plan view of conductive layers for a multi-band slot resonating ring antenna having additional apertures. Embodiments represented by FIG. 6 include concentric slots 204, 206, and 208 on a first conductive layer, feed line 220 on a second conductive layer, and apertures 214, 216, and 218 on a third conductive layer, all described above. FIG. 6 also includes additional apertures 614, 616, and 618 oriented laterally from apertures 214, 216, and 218.

Apertures 214, 216, and 218, provide coupling between feed line 220 and the concentric slots as described above. Apertures 614, 616, and 618 do not have a feed line oriented beneath them, and so do not provide coupling from a feed line to the concentric slots. Apertures without a corresponding feed line, or without a feed line that is driven by a signal, are referred to herein as "dummy apertures." The polarization purity of the SRRA may be improved by the aperture coupling architecture of FIG. 6. In the dummy aperture feeding scheme, as illustrated in FIG. 6, two apertures are employed to feed each of the SRR elements for the same polarization operation, and only one coupling aperture is coupled with radio signal feed line. The extra dummy aperture for the same polarization operation is introduced to decrease the cross polarization level. Although a total of two coupling apertures are introduced for the same polarization operation, only one of them is actually excited by a radio signal through the aperture coupling and therefore the complexity of the feeding networks of the antenna is not increased. The rationale of the dummy aperture feeding technique is that the introduction of the dummy aperture could enhance the symmetry of electromagnetic field distribution inside the radiation element, and thereafter improve the polarization purity.

Figure 7:
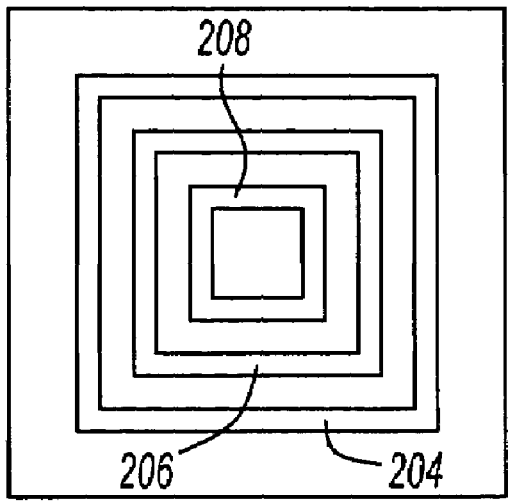
Figure 7:
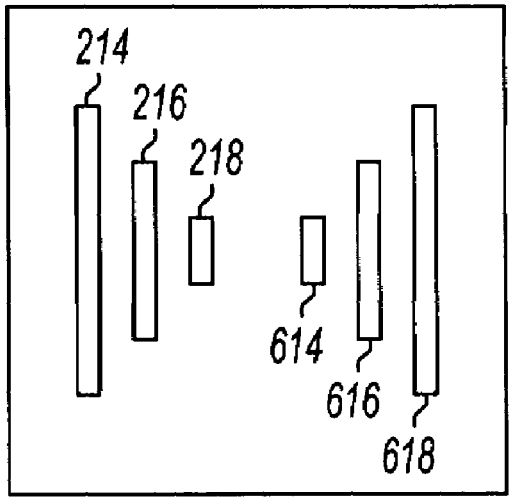
Figure 7:
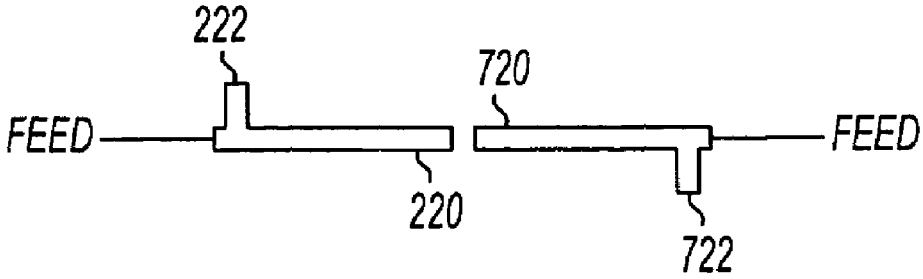

FIG. 7 shows a plan view of conductive layers for a multi-band slot resonating ring antenna having additional apertures and balanced feed lines. The circuits of FIG. 7 include all of the elements of FIG. 6, including the additional apertures 614, 616, and 618. FIG. 7 also includes an additional feed line 720 with matching circuit 722. In the balanced feeding scheme illustrated in FIG. 7, the signals driving the two feed lines 220, 720, may be out of phase with each other and may be directly connected to the differential pins of a radio frequency integrated circuit (RFIC) without using the a balun. The balanced feeding scheme of FIG. 7 increases polarization purity.

In some embodiments, two microstrip feed lines are included as shown in FIG. 7, but only one is driven with a signal. For example, in some embodiments, feed line 720 may be included, but not coupled to a signal path.

Figure 8:
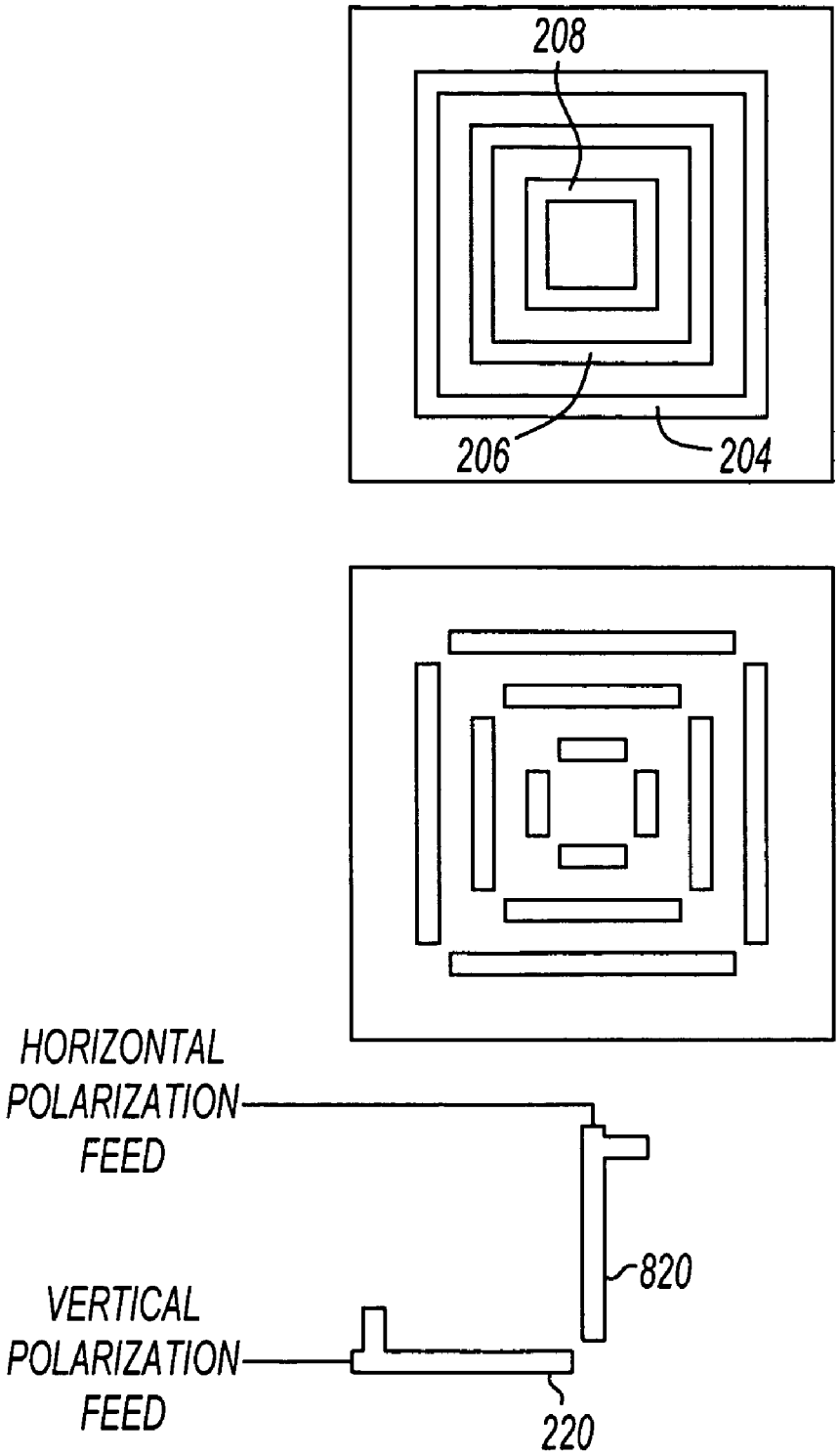

FIG. 8 shows a plan view of conductive layers for a multi-band slot resonating ring antenna having dual polarization with dummy apertures. Dual polarization may be implemented for polarization diversity applications. As shown in FIG. 8, feed lines 220 and 820 are oriented as substantially 90 degrees to another. Signals feeding feed line 220 are transmitted with a vertical polarization, and signals feeding feed line 820 are transmitted with a horizontal polarization. Further, four sets of coupling apertures are shown in FIG. 8, two sets of coupling apertures are oriented between the feed lines and concentric slots, and two sets of apertures are oriented as dummy apertures. FIG. 8 presents the architecture of a compact slot resonating ring antenna with aperture coupling and dummy aperture for multi-band and dual polarization operation.

Figure 9:
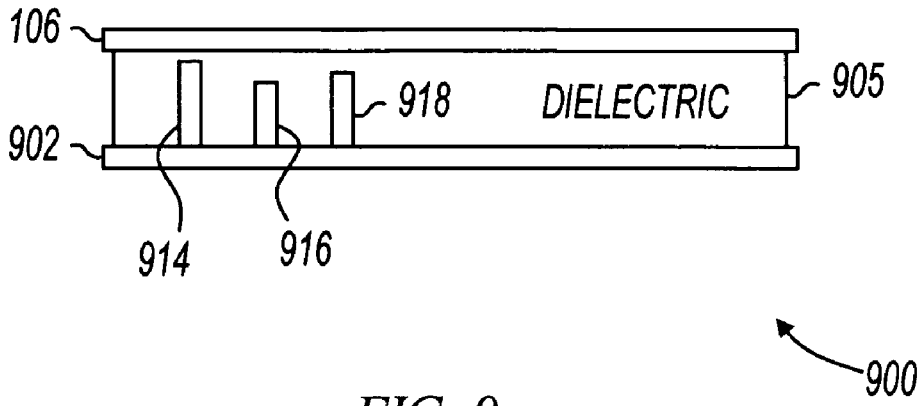
FIG. 9 shows a circuit board cross-section.

FIG. 9 shows a circuit board cross section. Circuit board 900 includes conductive layers 902 and 106, and also includes dielectric 905 separating the conductive layers. Conductive layer 106 includes concentric slots as described above. Conductive layer 902 forms a plane, and may be used as a voltage or ground plane as described above. Circuit board 900 also includes probes 914, 916, and 918. Probes are insulated from conductive layer 902, and are oriented beneath each of the concentric slots.

In operation, each of probes 914, 916, and 918 are driven with electrical signals, and the probes emit signal energy to be coupled with the concentric slots. In some embodiments, one or more signal traces exists between conductive layers 902 and 106 to provide electrical signal(s) to the probes. In other embodiments probes 914, 916, and 918 are fed from below conductive layer 902. The probes may be fed separately, or in common.

Figure 10:
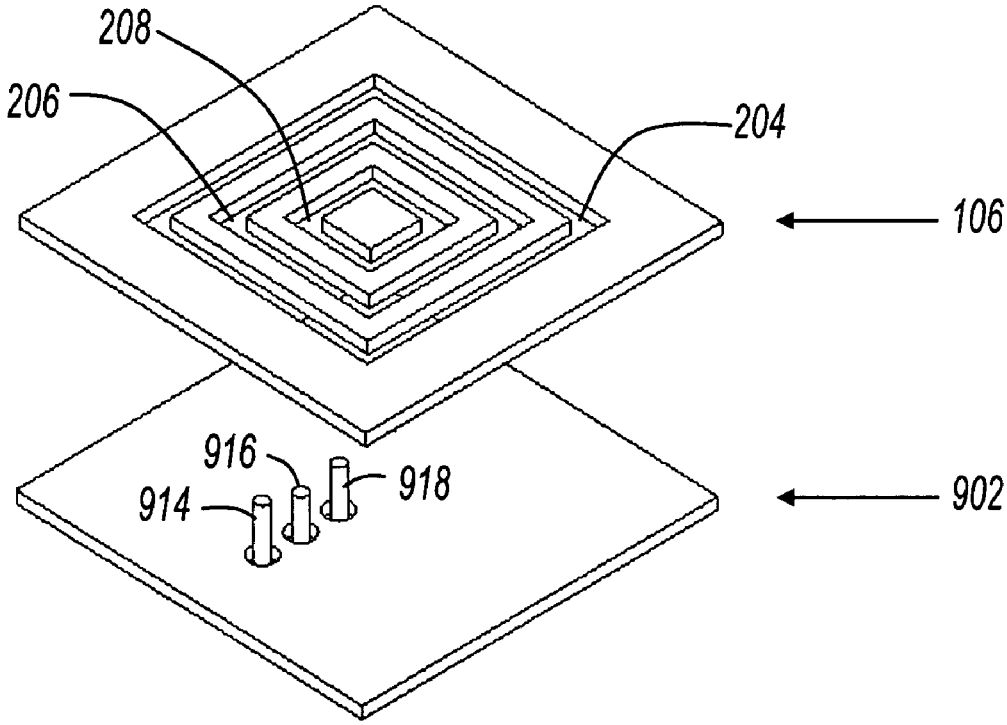
FIG. 10 shows an exploded view of conductive layers of a multi-band slot resonating ring antenna.

FIG. 10 shows an exploded view of the conductive layers of a multi-band slot resonating ring antenna formed in circuit board 900 (FIG. 9). Conductive layer 106 is shown having concentric slots 204, 206, and 208, and is described with reference to previous figures. Conductive layer 902 is shown having probes 914, 916, and 918 with major axes substantially perpendicular to conductive layer 902. In some embodiments, the probes are aligned with an associated slot. For example, probe 914 may be aligned with slot 204; probe 916 may be aligned with slot 206, and probe 918 may be aligned with slot 208. In the probe feeding scheme, the impedance matching is realized by the appropriate probe height to increase the coupling and associated power transfer.

Figure 11:
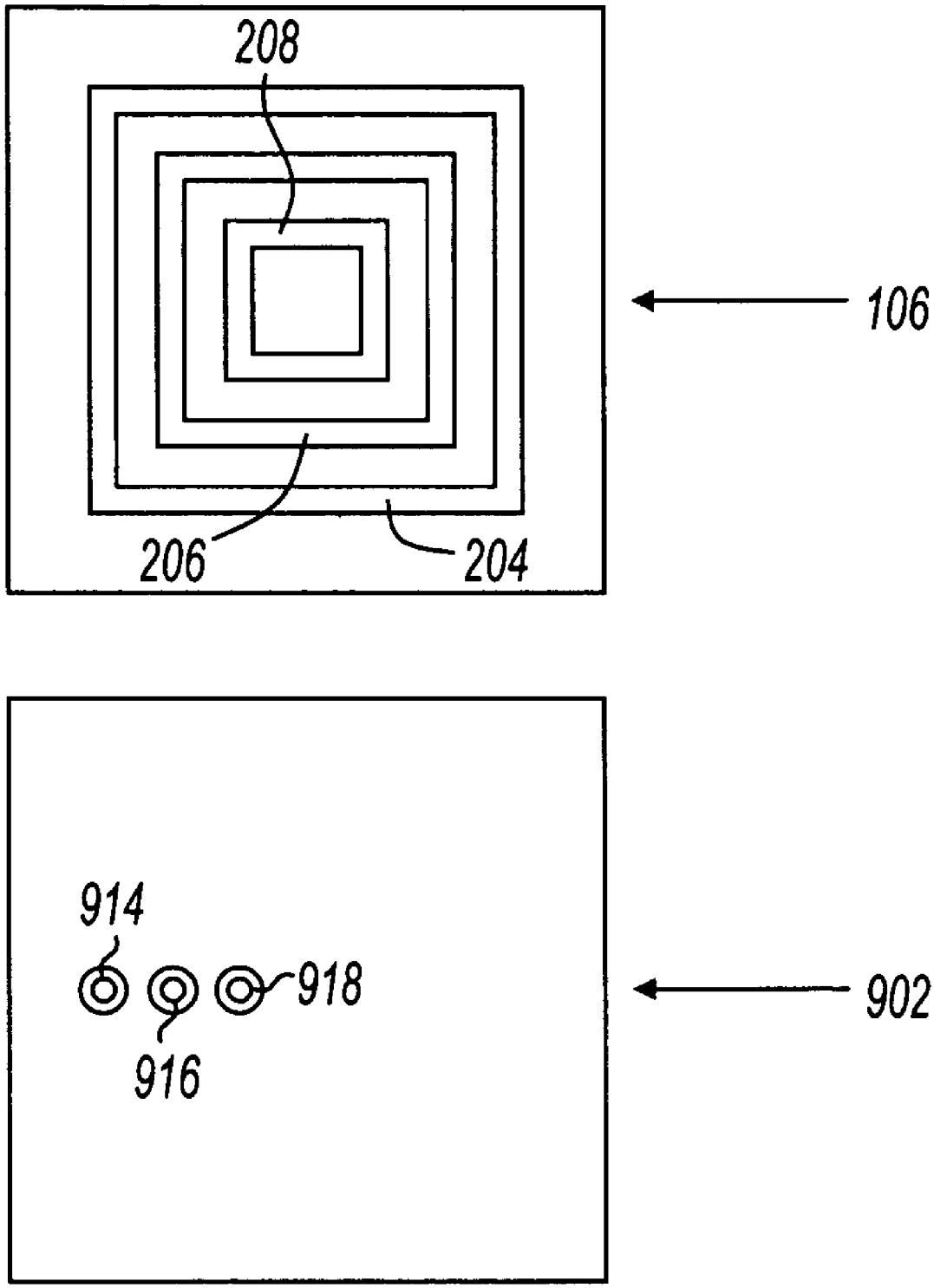
FIG. 11 shows a plan view of each layer of the multi-band slot resonating ring antenna of FIG. 10.

FIG. 11 shows a plan view of each layer of the multi-band slot resonating ring antenna of FIG. 10. Probes 914, 916, and 918 can be seen insulated from conductive layer 902. The probes are oriented beneath the corresponding concentric slot.

Figure 12:
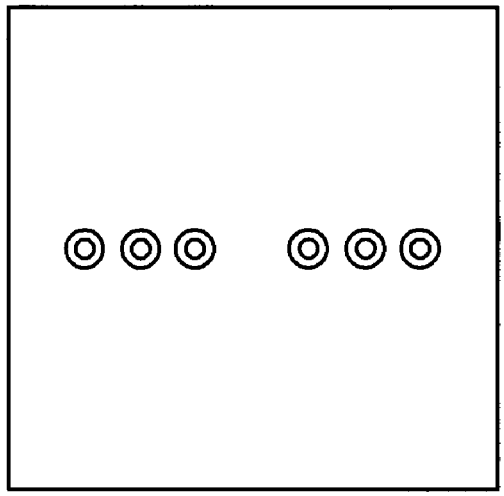
FIGS. 12-14 show plan views of conductive layers for various multi-band slot resonating ring antenna embodiments.
Figure 13:
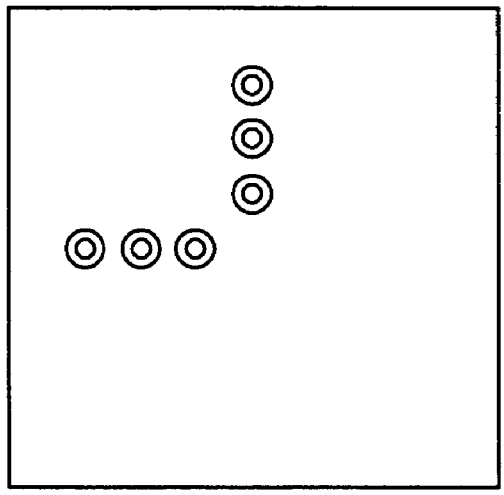
Figure 14:
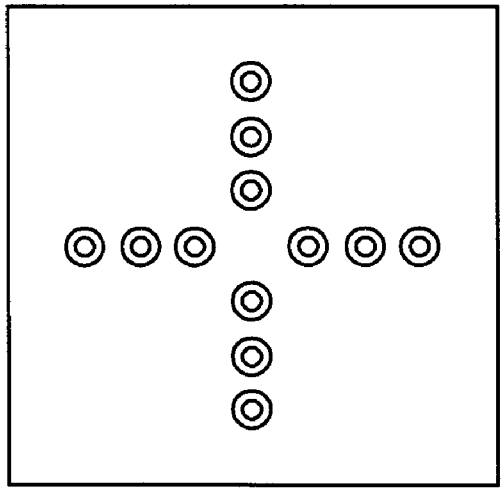

FIGS. 12-14 show plan views of conductive layers and feeding probes for various multi-band slot resonating ring antenna embodiments. FIG. 12 shows two sets of feeding probes oriented substantially 180 degrees from each other. In some embodiments, one set of probes is driven, and the second set of probes are dummy probes. Dummy feeding probes may enhance the symmetry of the electromagnetic field distribution in the radiating elements, and improve polarization purity. In the dummy probe feeding scheme, each of the slot resonating rings is fed by two symmetrical probes—where only one probe is physically connected to the radio signal and the dummy probe is not connected to the radio signal. In other embodiments, both sets of probes are driven, and the SRRA is a "multiple feed line" antenna.

FIG. 13 shows two sets of feeding probes oriented substantially 90 degrees from each other. In some embodiments, both sets of probes are driven to provide dual polarization. FIG. 14 shows four sets of feeding probes. Any combination of feeding probes may be driven with signals. For example, in some embodiments, the probes on the left and top may be driven for dual polarization, while the probes on the right and bottom may be dummy probes. In other embodiments, the probes on the left and right may be driven with one set of signals, while the probes on the top and bottom may be driven with a set of out of phase signals for polarization diversity. This balanced feeding scheme and the associated isolation among the feeding probes may result in reducing the cost of the overall wireless devices by eliminating or relaxing the specifications of key components of radio front ends, including switches, diplexers, baluns, and band pass filters.

Figure 15:
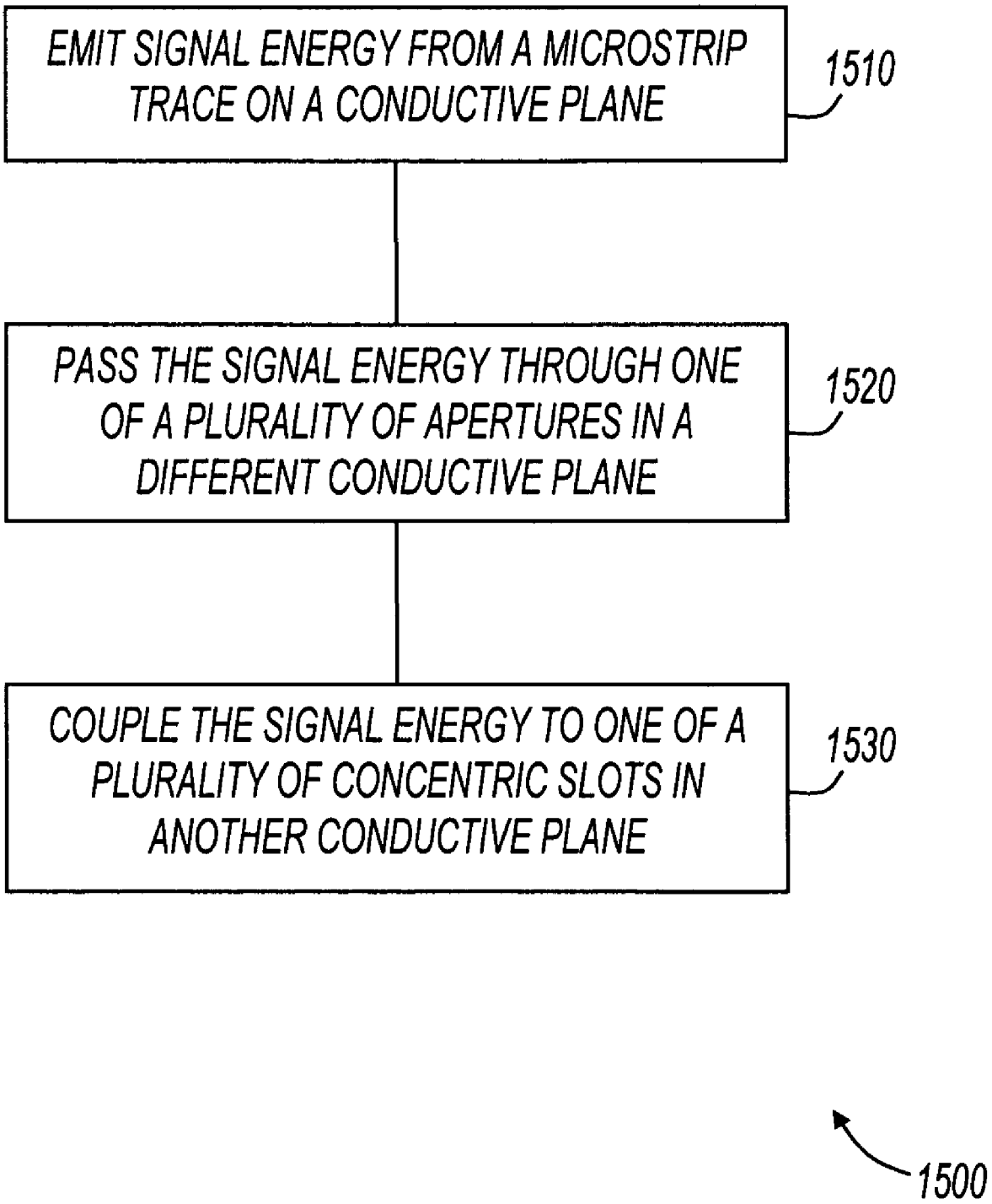
FIG. 15 shows a flowchart in accordance with various embodiments of the present invention.

FIG. 15 shows a flowchart in accordance with various embodiments of the present invention. In some embodiments, method 1500 may be used by a wireless device or a slot resonating ring antenna to couple signal energy. Method 1500 is not limited by the particular type of apparatus, or system performing the method. The various actions in method 1500 may be performed in the order presented, or may be performed in a different order. Further, in some embodiments, some actions listed in FIG. 15 are omitted from method 1500.

Method 1500 is shown beginning at block 1510 in which signal energy is emitted from a microstrip trace on a conductive plane. This may correspond to feed line 220 (FIG. 2) emitting signal energy. At 1520, the signal energy is passed through one of a plurality of apertures in a different conductive plane. This may correspond to signal energy passing through any of the apertures shown in the various figures. For example, signal energy may pass through any of the apertures shown in FIGS. 2, 3, 6, 7, or 8. In some embodiments, signal energy is passed through a first set of apertures to provide a signal at a first polarization, and signal energy is passed through a second set of apertures oriented substantially 90 degrees from the first set of apertures to provide a signal at a second polarization.

At 1530, the signal energy is coupled to one of a plurality of concentric slots in another conductive plane. In various embodiments of the present invention, this corresponds to coupling signal energy to concentric slots 214, 216, and 218 in conductive plane 106.

Figure 16:
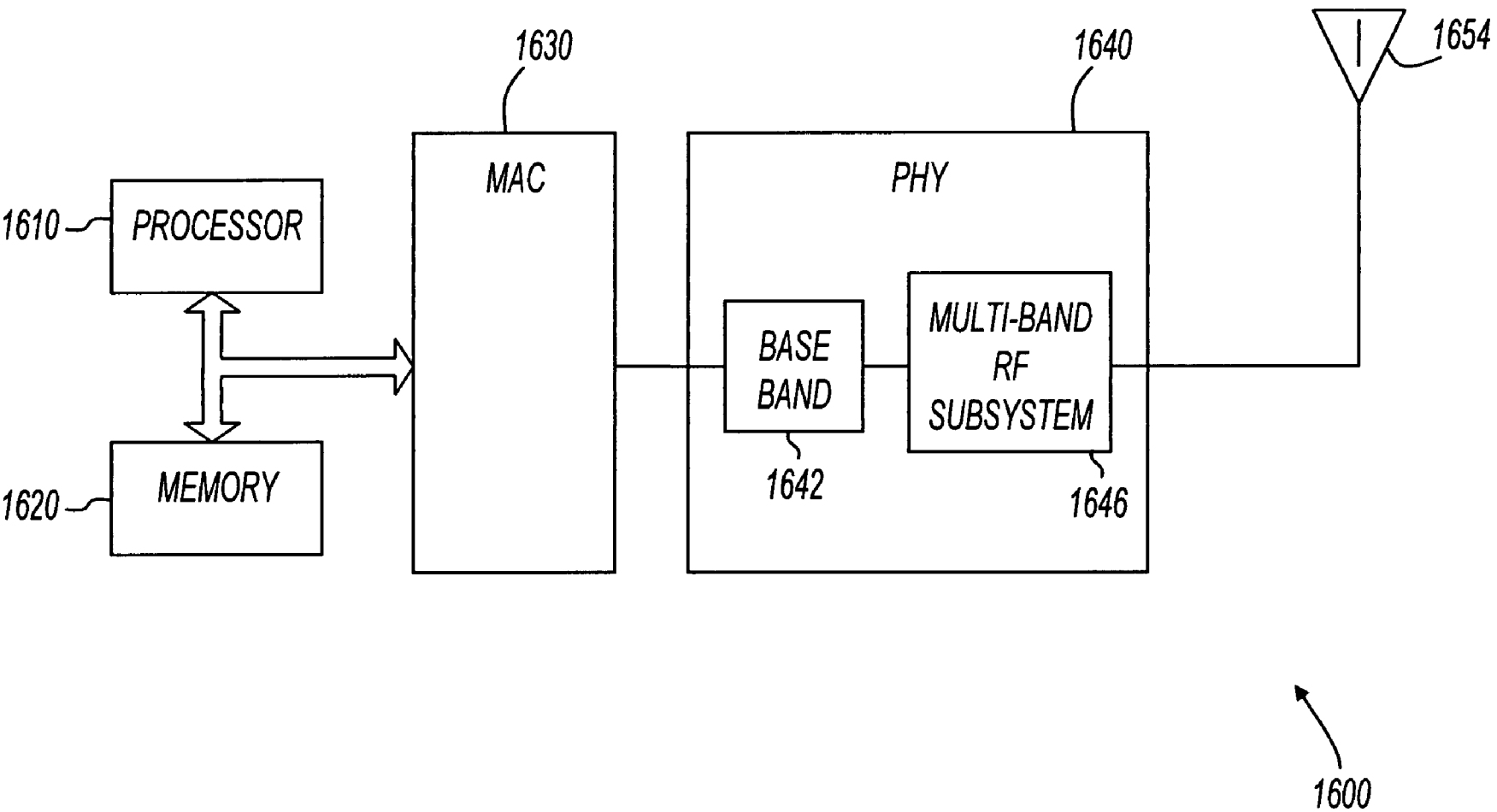
FIG. 16 shows a block diagram of an electronic systems in accordance with various embodiments of the present invention.

FIG. 16 shows a system diagram in accordance with various embodiments of the present invention. Electronic system 1600 includes antenna 1654, physical layer (PHY) 1640, media access control (MAC) layer 1630, processor 1610, and memory 1620. In operation, system 1600 sends and receives signals using antenna 1654, and the signals are processed by the various elements shown in FIG. 16.

Antenna 1654 may be any of the slot resonating ring antenna embodiments described herein. For example, antenna 1654 may include coupling apertures or feed probes. Further, antenna 1654 may include dummy apertures or dummy feed probes. Still further, antenna 1654 may include a single feed line or multiple feed lines. In addition, antenna 1654 may have any polarization, including dual polarization.

Physical layer (PHY) 1640 is coupled to antenna 1654 to interact with other wireless devices. PHY 1640 may include circuitry to support the transmission and reception of radio frequency (RF) signals. For example, as shown in FIG. 16, PHY 1640 includes multi-band radio, frequency (RF) subsystem 1646 and baseband circuits 1642. In some embodiments, RF circuits 1646 include additional functional blocks to perform analog-to-digital conversion, digital-to-analog conversion, filtering, frequency conversion or the like.

Multi-band RF subsystem 1646 receives signals from antenna 1654 and performs additional processing. For example, in some embodiments, multi-band RF subsystem 1646 performs low noise amplification (LNA), frequency down-conversion, demodulation, or other functions. Further, in some embodiments, multi-band RF subsystem 1646 also includes a transmitter, and performs modulation, filtering, frequency up-conversion, power amplification, or the like. Examples of multi-band RF subsystem configurations are described with reference to FIGS. 17-19, below.

Baseband circuit 1642 may be any type of circuit to provide digital baseband processing in a communications system. In some embodiments, baseband circuit 1642 includes a processor such as a digital signal processor (DSP), and in other embodiments, baseband circuit 1642 is implemented as a system on a chip (SOC) that includes many functional blocks.

PHY 1640 may be adapted to transmit/receive and modulate/demodulate signals of various formats and at various frequencies. For example, PHY 1640 may be adapted to receive ultra-wideband (UWB) signals, time domain multiple access (TDMA) signals, code domain multiple access (CDMA) signals, global system for mobile communications (GSM) signals, orthogonal frequency division multiplexing (OFDM) signals, multiple-input-multiple-output (MIMO) signals, spatial-division multiple access (SDMA) signals, or any other type of communications signals. The various embodiments of the present invention are not limited in this regard.

Media access control (MAC) layer 1630 may be any suitable media access control layer implementation. For example, MAC 1630 may be implemented in software, or hardware or any combination thereof. In some embodiments, a portion of MAC 1630 may be implemented in hardware, and a portion may be implemented in software that is executed by processor 1610. Further, MAC 1630 may include a processor separate from processor 1610.

Processor 1610 may be any type of processor capable of communicating with memory 1620, MAC 1630, and other functional blocks (not shown). For example, processor 1610 may be a microprocessor, digital signal processor (DSP), microcontroller, or the like.

Memory 1620 represents an article that includes a machine readable medium. For example, memory 1620 represents a random access memory (RAM), dynamic random access memory (DRAM), static random access memory (SRAM), read only memory (ROM), flash memory, or any other type of article that includes a medium readable by processor 1610. Memory 1620 may store instructions for performing software driven tasks. Memory 1620 may also store data associated with the operation of system 1600.

Example systems represented by FIG. 16 include cellular phones, personal digital assistants, wireless local area network interfaces, wireless wide area network stations and subscriber units, and the like. For example, system 1600 may be a multi-band multi-standard mobile wireless devices using multiple antennas: one for cellular application, one for GPS application, and one for wireless LAN and/or Bluetooth application. Further, in some embodiments, additional antennas are utilized for mobile TV operation (e.g., DVB-H, T-DMB, ISDB) and/or wide wireless area network (WWAN) operation (e.g., WiMAX). The multi-band SRRA embodiments may be used to replace multiple antennas with a single, highly integrated and compact antenna design. Many other systems uses for multi-band slot resonating ring antennas exist. For example, antenna 1654 may be used in any system without a processor.

Figure 17:
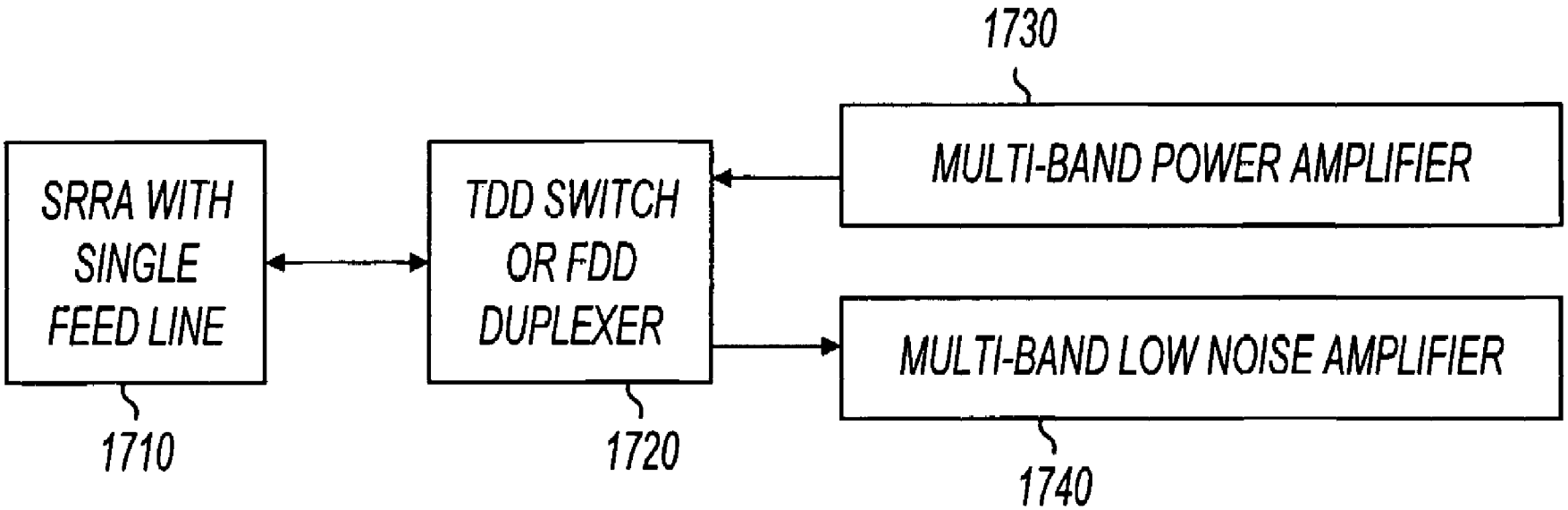
FIGS. 17-19 show various antenna/amplifier coupling schemes in accordance with various embodiments of the present invention.
Figure 18:
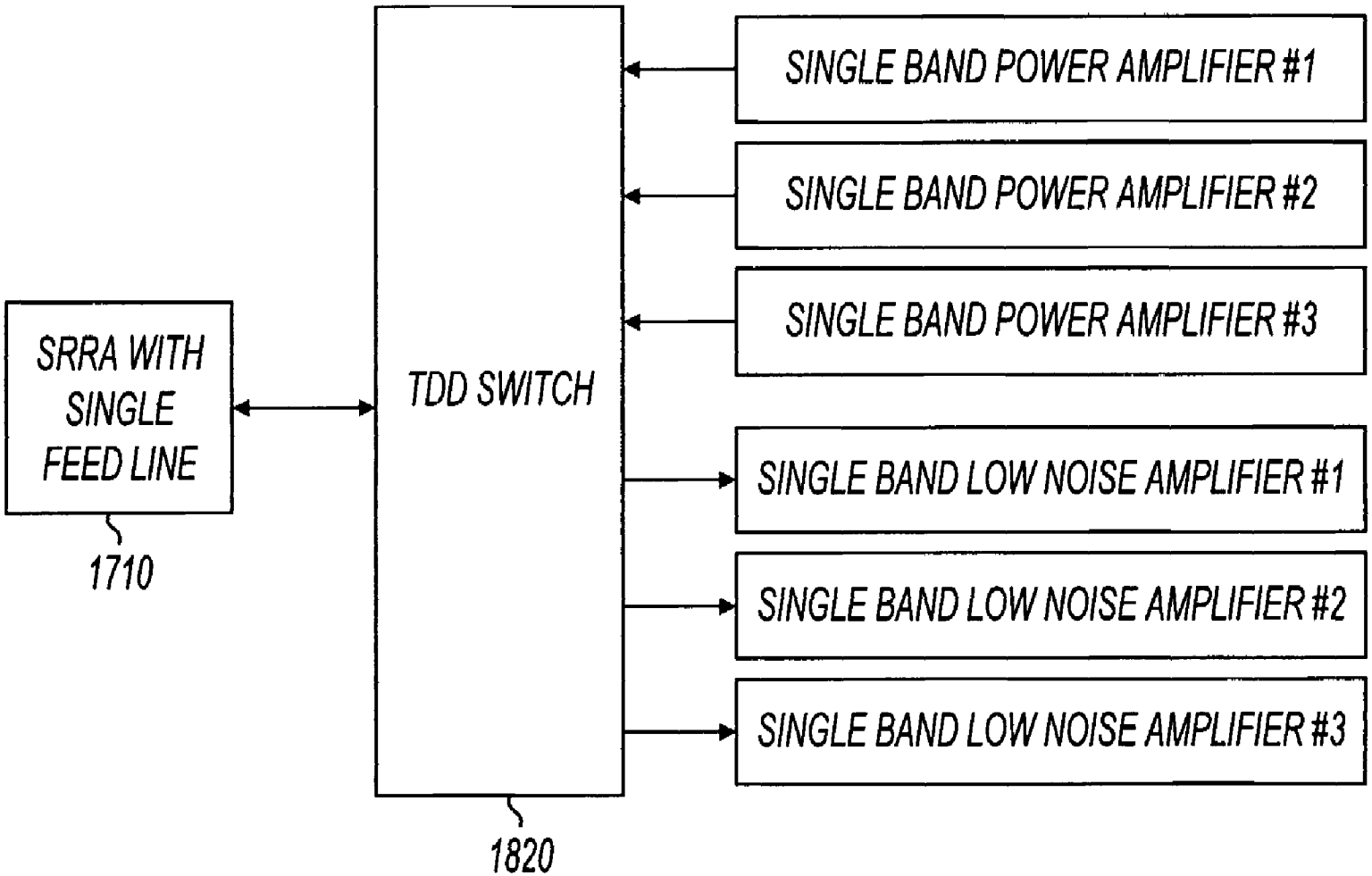
Figure 19:
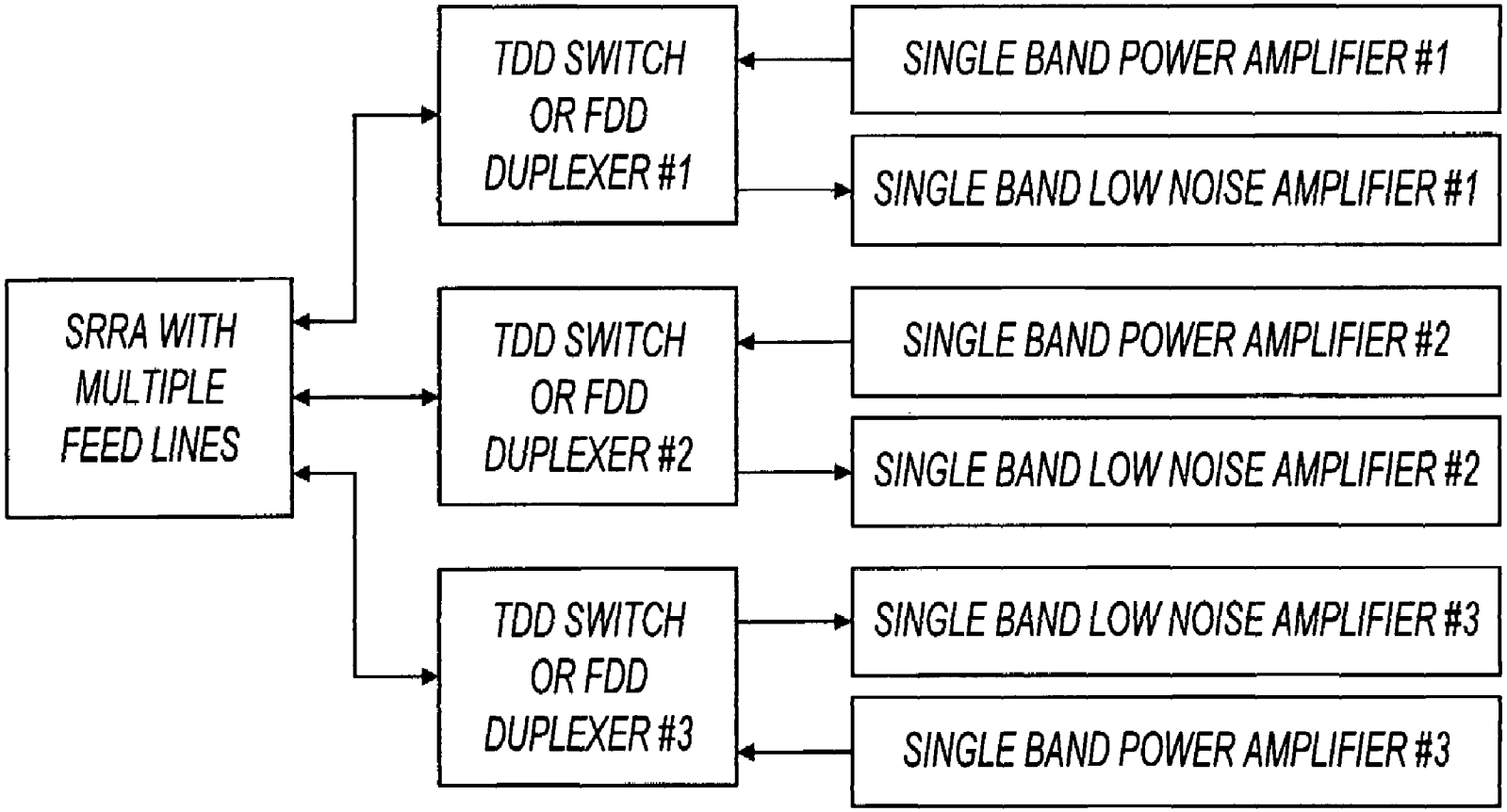

FIGS. 17-19 show various antenna/amplifier coupling schemes in accordance with various embodiments of the present invention. The antennas of FIGS. 17-19 may be implemented as any of the antenna embodiments disclosed herein.

FIG. 17 shows antenna 1710, TDD switch or FDD duplexer 1720, multi-band power amplifier 1730, and multi-band low noise amplifier 1740. Antenna 1710 has a single feed line that is switched between transmit and receive operations. Further, the multi-band amplifiers are frequency multiplexed between the various operating frequencies supported by the antenna.

FIG. 18 includes antenna 1710, TDD switch 1820, three single band power amplifiers in parallel, and three low noise amplifiers in parallel. In operation, the coupling scheme of FIG. 18 provides for simultaneous multi-band operation for either transmit or receive operations.

FIG. 19 shows a single antenna with multiple feed lines, with each feed line coupled to a TDD switch or FDD duplexer. Each TDD switch or FDD duplexer is coupled to a single-band power amplifier for transmission, and a single-band low noise amplifier for reception.

Although the present invention has been described in conjunction with certain embodiments, it is to be understood that modifications and variations may be resorted to without departing from the spirit and scope of the invention as those skilled in the art readily understand. Such modifications and variations are considered to be within the scope of the invention and the appended claims.

What is claimed is:

1. An apparatus comprising:

a first conductive layer having at least two concentric slots;

a second conductive layer having a signal trace to emit signal energy; and a third conductive layer positioned between the first conductive layer and the second conductive layer, the third conductive layer having at least one aperture to couple signal energy from the second conductive layer to the first conductive layer, wherein the third conductive layer includes one aperture for each of the concentric slots on the first conductive layer.

2. The apparatus of claim 1 wherein the first conductive layer is electrically coupled to electronic circuits to serve as a reference voltage plane.

3. The apparatus of claim 1 further comprising a second signal trace on the second conductive layer placed to couple signal energy to the first conductive layer through the at least one aperture.

4. An apparatus comprising:

a slot resonating ring antenna formed from a plurality of concentric slots in a ground plane of a circuit board;

a second conductive circuit board layer substantially parallel to the ground plane, the second conductive circuit board layer having at least one aperture for each of the plurality of concentric slots to allow signal energy to pass to the slot resonating ring antenna; and a third conductive circuit board layer substantially parallel to the ground plane and on a side of the second conductive circuit board layer opposite the ground plane, wherein the third conductive circuit board layer includes a feed line to emit the signal energy.

5. The apparatus of claim 4 further comprising two feed lines coupled to the slot resonating ring antenna through the at least one aperture.

6. The apparatus of claim 5 wherein the two feed lines are oriented 90 degrees to each other.

7. The apparatus of claim 5 wherein the two feed lines are oriented 180 degrees to each other.

8. The apparatus of claim 7 wherein the two feed lines are configured to be driven out of phase.

9. A method comprising coupling signal energy to a multi-band slot resonating ring antenna having a plurality of concentric slots in a first conductive plane by passing the signal energy through at least one aperture for each of the plurality of concentric slots, the at least one aperture in a second conductive plane situated substantially parallel to the first conductive plane, wherein the signal energy is emitted from a feedline formed in a third conductive plane on a side of the second conductive plane opposite the first conductive plane.

10. The method of claim 9 wherein passing the signal energy through at least one aperture comprises:

passing signal energy through a first plurality of apertures to emit electromagnetic energy from the multi-band slot resonating ring antenna in a first polarization; and passing signal energy through a second plurality of apertures to emit electromagnetic energy from the multi-band slot resonating ring antenna in a second polarization.

11. The method of claim 10 wherein the first and second polarization are substantially 90 degrees apart.

12. An electronic system comprising:

a microprocessor;

radio frequency circuits coupled to the microprocessor, the radio frequency circuits comprising an amplifier affixed to a circuit board; and a slot resonating ring antenna formed in a ground plane of the circuit board, a second conductive circuit board layer substantially parallel to the ground plane, the second conductive circuit board layer having at least one aperture to allow signal energy to pass to the slot resonating ring antenna, and a third conductive circuit board layer substantially parallel to the ground plane and situated on a side of the second conductive circuit board layer opposite the ground plane, the third conductive circuit boar layer including a feed line coupled to an output of the amplifier, wherein the feed line is oriented to emit the signal energy through the at least one aperture, wherein the slot resonating ring antenna is formed as a plurality of concentric slots in the ground plane, and the at least one aperture comprises one aperture for each of the plurality of concentric slots.

13. The electronic system of claim 12 further comprising two feed lines, and the second conductive circuit board layer includes two pluralities of apertures, wherein a first of the two feed lines is oriented to emit signal energy through a first of the two pluralities of apertures, and a second of the two feed lines is oriented to emit signal energy through a second of the two pluralities of apertures.

* * * * *